US010549288B2

(12) United States Patent
Lehnberger et al.

(10) Patent No.: US 10,549,288 B2
(45) Date of Patent: Feb. 4, 2020

(54) DEVICE HAVING A DISCONTINUOUSLY OPERATING CENTRIFUGE FOR SEPARATING SYRUP FROM SUGAR MASSECUITES AND METHOD FOR OPERATING SUCH A DEVICE

(71) Applicants: Andreas Lehnberger, Braunschweig (DE); Dirk Spangenberg, Badersleben (DE); Igor Djoukwe, Braunschweig (DE)

(72) Inventors: Andreas Lehnberger, Braunschweig (DE); Dirk Spangenberg, Badersleben (DE); Igor Djoukwe, Braunschweig (DE)

(73) Assignee: BMA BRAUNSCHWEIGISCHE MASCHINENBAUANSTALT AG, Braunschweig (DE)

( * ) Notice: Subject to any disclaimer, the term of this patent is extended or adjusted under 35 U.S.C. 154(b) by 0 days.

(21) Appl. No.: 14/342,569

(22) PCT Filed: Mar. 13, 2013

(86) PCT No.: PCT/EP2013/055157
§ 371 (c)(1),
(2) Date: Mar. 4, 2014

(87) PCT Pub. No.: WO2013/135774
PCT Pub. Date: Sep. 19, 2013

(65) Prior Publication Data

US 2015/0290662 A1 Oct. 15, 2015

(30) Foreign Application Priority Data

Mar. 14, 2012 (DE) ..... 10 2012 004 968

(51) Int. Cl.
*B04B 11/04* (2006.01)
*C13B 30/06* (2011.01)
(Continued)

(52) U.S. Cl.
CPC ..... *B04B 11/04* (2013.01); *B04B 7/02* (2013.01); *B04B 13/00* (2013.01); *C13B 20/16* (2013.01); *C13B 30/06* (2013.01)

(58) Field of Classification Search
CPC ..... B04B 11/04; B04B 13/00; B04B 7/02; C13B 20/16; C13B 30/06
(Continued)

(56) References Cited

U.S. PATENT DOCUMENTS

2019/0046998 A1* 2/2019 Stephens ..... B01D 11/0273

FOREIGN PATENT DOCUMENTS

DE 95969 4/1897
DE 109702 5/1899
(Continued)

OTHER PUBLICATIONS

DE 1278952 Description Espacenet Machine Translation.*
DE 19731097 Description Espacenet Machine Translation.*

*Primary Examiner* — Charles Cooley
(74) *Attorney, Agent, or Firm* — Salter & Michaelson

(57) ABSTRACT

A device having a centrifuge operating discontinuously in batch-type manner for separating syrup from sugar massecuites including a centrifuge housing having a wall and a base, as well as a cylindrical centrifuge drum in a centrifuge housing having discharge openings. A first receiving container serves for the reception of a green discharge. A second receiving serves for the reception of a white discharge. A control device and valve or shut-off assemblies controllable by the control device are provided at or in the discharge opening or in connecting lines for the purposes of
(Continued)

separating the green discharge and the white discharge. At least one sensor is provided in the transport path of the syrup. The sensor includes a measuring device for the measurement of a physical value which is representative of the difference between green discharge and white discharge. The control device controls the valve or shut-off assemblies in dependence on the measured values of the physical value transmitted by the sensor.

25 Claims, 7 Drawing Sheets

(51) Int. Cl.

| | |
|---|---|
| ***B04B 7/02*** | (2006.01) |
| ***C13B 20/16*** | (2011.01) |
| ***B04B 13/00*** | (2006.01) |

(58) Field of Classification Search
USPC ..... 494/2, 10, 37
See application file for complete search history.

(56) References Cited

FOREIGN PATENT DOCUMENTS

| | | | | | |
|---|---|---|---|---|---|
| DE | 1278952 | B | * | 9/1968 | ..... B04B 3/00 |
| DE | 197 23 601 | | | 6/1998 | |
| DE | 197 31 097 | | | 8/1998 | |
| DE | 19731097 | C1 | * | 8/1998 | ..... B04B 7/02 |
| DE | 100 02 862 | | | 8/2001 | |
| EP | 0 679 722 | | | 11/1995 | |
| EP | 1405674 | A2 | * | 4/2004 | ..... B04B 11/043 |
| EP | 1 405 674 | | | 7/2004 | |
| EP | 2 275 207 | | | 1/2011 | |
| GB | 466142 | A | * | 5/1937 | ..... C13B 30/02 |

* cited by examiner

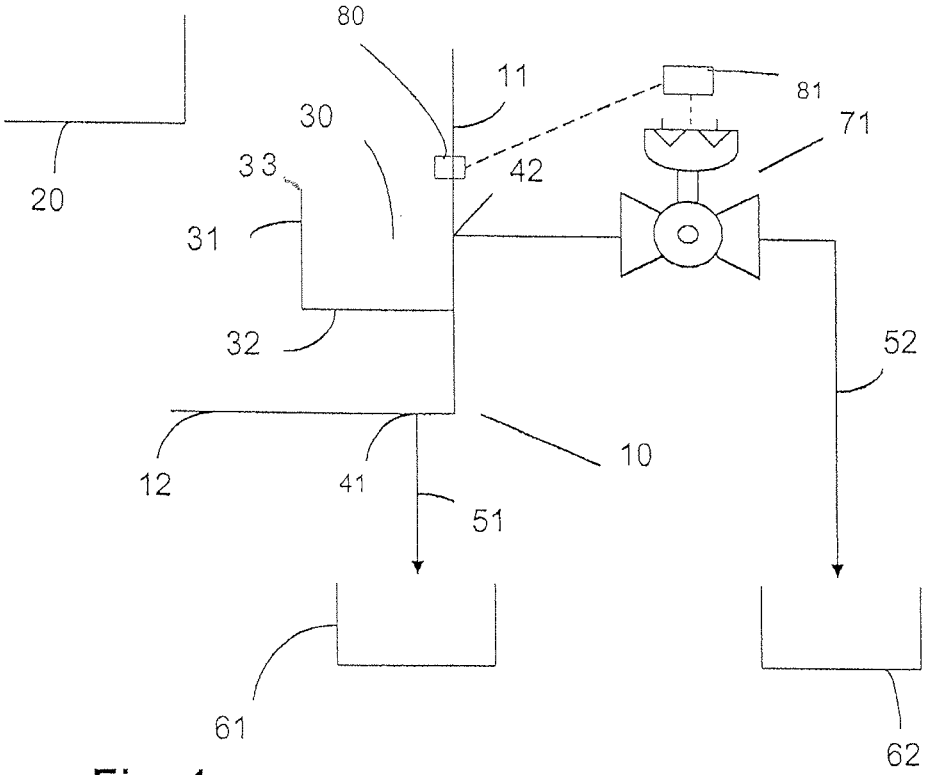
Fig. 1
Fig. 2
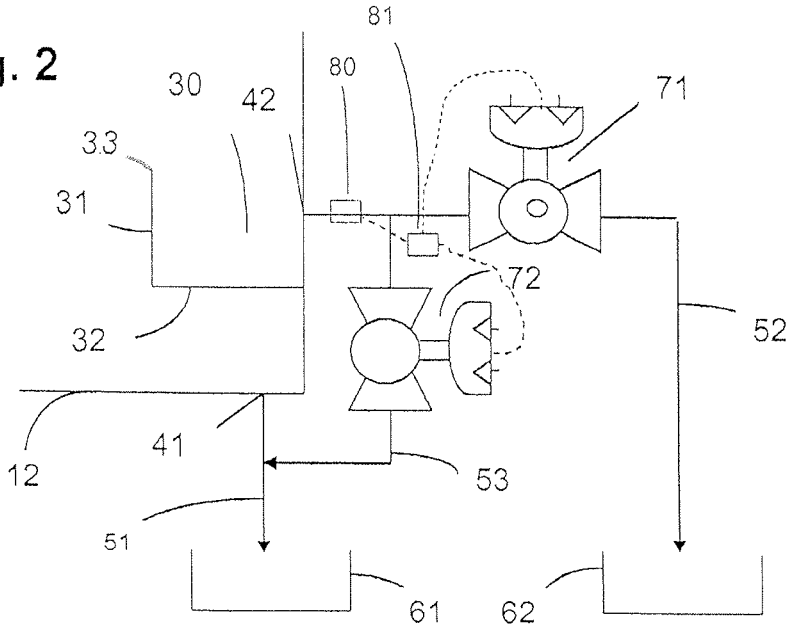

DEVICE HAVING A DISCONTINUOUSLY OPERATING CENTRIFUGE FOR SEPARATING SYRUP FROM SUGAR MASSECUITES AND METHOD FOR OPERATING SUCH A DEVICE

TECHNICAL FIELD

The invention relates to a device having a centrifuge that operates discontinuously in chargewise manner for separating syrup from sugar massecuites, comprising a centrifuge housing having a wall and a base, a cylindrical centrifuge drum in the centrifuge housing, drainage openings in the centrifuge housing, a first receiving container for the syrup draining from the drainage openings for receiving green run-off in particular, a second receiving container for the syrup draining from the drainage openings for receiving white run-off in particular, a control device, and also valve or shut-off assemblies which are controllable by the control device and are located at or in the drainage openings or in connecting lines from the drainage openings to the receiving containers for the purposes of separating the green run-off and the white run-off. Moreover, the invention relates to a method for separating syrup from sugar massecuites by means of a discontinuously operating centrifuge.

BACKGROUND OF THE INVENTION

Discontinuously or periodically operating centrifuges are much used for producing sugar. We are concerned here with the processing step in which a sugar massecuite is spun off in a rotating centrifuge drum. In connection therewith, the centrifuge drum has a cover screen through which the syrup separated from the massecuite passes whereafter it then enters a centrifuge housing, in which the centrifuge drum is arranged, from the openings in the casing of the centrifuge drum.

The crystals released from the syrup in this way are then washed in the centrifuge drum with water or a highly purified syrup from a subsequent method step and finally removed from the centrifuge drum at the end of the separation process by a scraping device.

Thus, in the course of the process, the consistency and the composition of the liquid which passes through the cover screen changes. Firstly, there is a so-called green run-off which contains a high proportion of non-sugar material, i.e. it has a comparatively low sugar content.

Subsequently, so-called white run-off emerges through the cover screen and this has a substantially greater sugar content than the green run-off from the first process step. The white run-off occurs when the crystal layer on the cover screen is first sprayed with water thereby rinsing out the residual syrup, and sugar crystals are dissolved and forced through the permeable casing of the centrifuge drum due to the centrifugal force.

Finally, after these steps, a third liquid that is nevertheless similar to the white run-off passes through the casing, namely, when the residues still adhering to the centrifuge drum are rinsed off with washing water after the process of peeling off the sugar.

All three components of the discharge mentioned above are valuable and can be further processed However, the composition thereof is so different that greatly differing processes are more appropriate for the subsequent treatment. Thus for example, the white run-off and the sugar substance referred to as the third liquid that is dissolved by the washing water can frequently be returned to the centrifuge drum at the same stage, perhaps during the next or next-but-one discontinuously effected processing step namely, in place of the washing water.

This is not possible, or at least is not appropriate for the green run-off. This is expediently fed back into the cycle for the production of sugar massecuites during one of the preceding stages or is processed in a different manner due to the high proportion of non-sugar material.

It would therefore be desirable if these discharges could be separated from one another.

This desire has indeed been in existence for a long time. Thus, DE-patent 95 969 has already proposed the provision in a centrifuge housing of a separator which has a plurality of drainage channels at differing heights with separate discharge openings in each case. The discharge openings are then closed independently of each other and the discharges of differing composition are thereby separated and removed.

In order to improve upon this method, DE-patent 109 702 proposes that a valve be utilised and that the actuation thereof should effect the separation process.

In addition, P. W. van der Poel, H. Schiweck and T. Schwartz in "Zuckertechnologie. Rüben and Rohrzuckerherstellung", Berlin (2000) at page 868 have proposed various measures for separating the green run-off and the white run-off immediately following it from each other by means of flaps or pivotal devices.

All these measures are confronted by the problem that the consistency of the white run-off and the green run-off is different and both do not impinge and then run off the inner wall of the centrifuge housing centrally in one position but do so over a 360° circular periphery, and they inevitably mix on their way from the centrifuge housing to the discharge point. The actual separation that is aimed for and desired does not occur and can at best lead to a fraction having a higher proportion of white run-off and a fraction having a lower proportion of white run-off.

A significant qualitative improvement becomes possible by using a proposal from DE 197 31 097 C1. Here an annular shutoff member having an external operating mechanism is arranged in the centrifuge housing near to the base. By appropriate actuation from the exterior, the time point at which the transition from the green run-off to the white run-off occurs can be matched exactly so that from this moment onwards the further drainage path of the syrup is changed by means of a lever mechanism in the interior of the centrifuge housing, i.e. the green run-off and the white run-off are diverted successively into different channels. The mixing process is thereby reduced and the separation process is improved.

Alternative proposals using shutoff members or channeling systems in the interior of the centrifuge housing are also known from DE 197 23 601 C1 and DE 100 02 862 A1

These proposals do indeed improve the quality but nevertheless they are mechanically complex and very difficult to construct and therefore expensive. Moreover, they also require regular maintenance, especially cleaning which is correspondingly difficult due to the arrangement thereof in the interior of the centrifuge housing and in addition they require the system to be stopped and therefore involve a time consuming temporary stoppage of the entire centrifuge so that the useful operational period thereof is limited accordingly.

It would be desirable, if instead, a process of separating the different kinds of syrup with acceptable quality but with lower constructional complexity were possible.

Consequently, the object of the present invention is to propose a device with the aid of which acceptable quality of the separation process is possible but with a lesser degree of constructional complexity.

SUMMARY OF THE INVENTION

In the case of a device in accordance with the present invention, this object is achieved by means of the invention in that at least one sensor is provided in the transport path of the syrup between the point of impingement of the syrup on the wall of the centrifuge housing and the controllable valve or shut-off assemblies, in that the sensor has a measuring device for the measurement of a physical value which is representative of the difference between green run-off and white run-off, and in that the control device is configured in such a way that it controls the valve or shut-off assemblies in dependence on the measured values of the physical value transmitted by the sensor.

Surprisingly, the problem is solved by a concept of this type.

Conventionally, during the processing of a charge in the discontinuous centrifuge, the syrup impinging against the wall and running down the wall is firstly guided into a green run-off container for a pre-determined period of time. The length of this time period was computed beforehand or determined on the basis of the experience of the operator of the centrifuge. Up to this time point that has been fixed in advance and specified by the specialists, the entire syrup was regarded as green run-off and treated accordingly. This applies both to historical centrifuges such as are known from the above mentioned DE-patent 95 969 as well as modern centrifuges such as are known from DE 197 31 097 C1. It is then assumed that as from this established time for the switching time point, the following quantity of syrup would have to be white run-off and be treated accordingly. Nevertheless, the excellent proposals discussed hereinabove are also needed for this change-over process in order to provide any possibility at all of successively separating the green run-off and the white run-off in temporal sequence into a form suitable for reception in receiving containers.

Switching back to the container for green run-off was then likewise effected at a clearly specified time, namely, at the beginning of the treatment of a new centrifuge charge, perhaps when filling with a new charge with magma.

In principle, it would have been possible with the centrifuges from the state of the art to deliberately set the time point differently, perhaps because of an exact knowledge of the size of filling or other parameters, which however, as a pre-condition, would again have required an exact knowledge of the developing effects and the shift of the time point. In practice however, this has not been done due to the high and in essence barely feasible level of complexity for the operator that is entailed thereby. An empirical determination of the optimal setting parameters on the basis of technical boundary conditions would also have been difficult to conceive.

However, due to the invention, there is now a possibility of drawing on a directly and also continuously measured parameter of the draining syrup which is simultaneously indicative of the quality of the syrup for the purposes of controlling the switch-over time point in a variable manner.

The switch-over time point is still the one at which there is a switch-over from the process of diverting the discharge into the receiving container for the green run-off to a process for diverting the discharge into a receiving container for the white run-off. A physical value which enables a precise and objective determination to be made as to whether the syrup is currently white run-off or green run-off is now drawn upon as the parameter. Thus for example, the colour of the discharge or else the conductivity of the discharge can be drawn upon as the representative physical value. In order to be able to specify the exact transition point from green run-off to white run-off in an even more defined manner, it has additionally been established by means of experiments that the first derivative of these values with respect to time can also be an interesting criterion, i.e. the speed with which the colour or luminosity or else the conductivity of the syrup changes.

In addition, one can also take into consideration that the values are different for each charge. In dependence too on the quality of the sugar or the quantity of sugar and the quantity of washing water being used and also on the type of this washing water which, for its part, may be composed of the syrup from succeeding processing stages, namely, other values for the luminosity, colour and electrical conductivity are obtained.

This is taken into consideration in that one determines the maximum value in a charge and then, from this maximum value, draws on the drop below a certain threshold as the value, wherein this threshold can be about 60% to 85% and especially around 80%.

In relation to the maximum value of 100%, such a threshold is low enough to be able to completely eliminate the initiation of a false signal in the event of the usual fluctuations in the measured values and it is high enough in any event to produce an effect and to be able to establish with certainty the difference between green run-off and white run-off.

By a combination of the various aforementioned representative physical measured values, such as the value for the luminosity with the value for the alteration of the electrical conductivity over time for example, then yet further optimisation of the optimal switching time can be achieved.

The colour values can, for example, be expressed in so-called ICUMSA units (International Commission for Uniform Methods of Sugar Analysis). Typically, in the case of the production of beet sugar, the colour in the discharge of raw sugar magma i.e. green run-off, is typically under 25,000 ICUMSA units, also designated IU. By contrast, the discharge of white sugar-2-magma, i.e. the white run-off, lies under 10,000 ICUMSA units and the colour of the so-called white sugar-1-magma or refined sugar magma is below 4000 ICUMSA units.

One can already appreciate from these values that a separation of green run-off from white run-off within the range of 60% to 85% makes it possible to provide an unambiguous separation process.

Consequently, in accordance with the invention, the commencement of the improvement in quality (whereby white run-off is regarded as being of better quality than green run-off) is drawn upon as the criterion for the change in the way the currently occurring discharge is deviated, whereby in comparison therewith, the worst quality of the discharge (i.e. the green run-off having the highest colour value) is drawn upon, this usually occurring shortly after the beginning of the centrifuge cycle.

The determination of the physical value of the syrup can be undertaken at different places. For the purposes of the change-over process, it then has to be taken into consideration that between the location at which the physical value is determined whereat a sensor is placed for example, and the location at which the change-over is to be effected such as perhaps the place where the shut-off or valve device is positioned, there may exist a length of path which the syrup still has to first traverse before it passes this change-over device. In connection therewith, this is naturally not a uniform length of path but a very complex path, although always the same, so that fixed values can be taken here.

Thus, in a device comprising a discontinuous centrifuge such as is similarly known from DE 197 31 097 C1, an arrangement of a sensor in the wall upon which the syrup impinges would be efficient, and preferably in the lower region of this wall. The downwardly streaming syrup flowing on the inner surface of the wall would then pass the sensor. The physical values, the colour for instance, could thereby be determined so that control of the further course of the process can then be specified by means of an appropriate signal.

A measurement in an annular channel would be possible in another method that is described in the following.

In particular, a method is used which is characterised in that during the centrifuging process, the green run-off is initially collected in the annular channel, in that, after the filling of the annular channel with the green run-off, the excess green run-off is allowed to run over the upper edge of the annular channel wall and reach the base of the centrifuge housing, in that, upon the change from green run-off to white run-off from the centrifuge drum, the shut-off assembly in the second connecting line opens and the contents of the annular channel flow into the second receiving container so that the annular channel is emptied, in that the white run-off is collected in the annular channel and is likewise fed into the second receiving container, and in that the green run-off on the base is fed into the first receiving container.

This embodiment of the invention deliberately accepts contamination of the resulting white run-off by a pre-determined and precisely defined quantity of green run-off. This goes against the grain for the skilled person who, from the very start, thus rejects deliberate degradation of the collectable products.

The advantages simultaneously attainable thereby more than counterbalance this disadvantage however, particularly as the ensuing proportions of the mixture are precisely predictable.

The initially emerging green run-off is collected by the provision of the discharge gutter or the peripheral annular channel. This green run-off fills the annular channel until the latter has reached its maximum volume and then flows over the upper edge of its wall. The volume fraction of the green run-off surmounting the upper edge then drips or then flows onto the base of the cylinder housing. The quantity of green run-off reaching the base of the centrifuge housing from over the wall significantly exceeds the volume that is collected in the annular channel. During this time period, at least that shut-off assembly which could enable the syrup to drain from the annular channel remains closed. The green run-off from the base of the centrifuge housing can be discharged into a receiving container even at this point in time, but it could be done at a later time point.

At a time point that is settable and determinable in advance, the substance pressing outwardly from the centrifuge drum and reaching the inner surface of the wall of the centrifuge housing due to the centrifugal force changes from green run-off to white run-off. In dependence on this time point, the shut-off assembly opens and opens the path from the annular channel to a second receiving container. This means that the green run-off that has already collected in the annular channel from the beginning of the centrifuging process is now moved to this second receiving container through the opened shut-off assembly and the associated connecting line.

Then however, this pre-determined volume of green run-off is joined by the whole of the white run-off which has now arrived in the now-emptied annular channel and from there flows on after it through the still opened shut-off assembly and likewise enters the same second receiving container. As already explained, a mixture consisting of a pre-determined portion of green run-off and an overwhelmingly preponderant quantity of white run-off now forms in this second receiving container.

Only green run-off is collected in the other, first receiving container.

At the conclusion of the process, these collected masses can each be further processed or passed back into the process at a desired location.

A very great advantage of this embodiment is that maintenance and cleaning work practically only has to occur outside the centrifuge housing. Moveable parts such as the shut-off assemblies for instance can be exchanged, possibly just for a short period, for replacement units outside the centrifuge housing and then cleaned or repaired if necessary without time pressures being brought to bear.

Only immovable parts, namely, the annular channel and the base, are to be found within the centrifuge housing outside the centrifuge drum, whereby these parts do not have to be maintained or repaired and could be designed from the very beginning in such a way as to enable them to be easily and unproblematically cleaned when cleaning of the centrifuge drum is due for instance.

Thus, the conventionally unwanted time delay is avoided just as are any problems of hygiene since there are no sugary residues that could possibly be trapped in movable parts due to the fact that these movable parts are unnecessary.

Nevertheless, the quality of the collectable discharge is better than the conventionally possible qualities obtainable from separation processes outside the centrifuge housings and almost as good as that obtainable in the proven devices known from DE 197 31 097 C1 for instance.

Here naturally, due to the provision of the sensor that is used in accordance with the invention and/or the measurement of the physical value which is representative of the difference between white run-off and green run-off, a still further defined separation process can take place since it also possible to effect a multiple change-over process precisely at the appropriate time point with practically no delay and therefore ensure that in reality only white run-off will enter the receiving container intended for white run-off and the green run-off is no longer enriched by additional fractions of the white run-off, as is compellingly necessary for safeguarding this separation process.

When considering physical values in connection with discontinuously operating sugar centrifuges until now, it is exclusively only static quantities of sugar crystals or at least static relative to the centrifuge drum that have been taken into consideration, by means of an ultrasonic measurement of sugar crystals in EP 0 679 722 B1 for example, whereby there, the thickness of the crystallised layer is used for controlling the further quantity of washing liquid. From EP 2 275 207 B1, the concept is known of a process for detection on the basis of the luminosity or colour of the filling material throughout the drying progress of this filling material of a charge for a discontinuous centrifuge by means of a spectrophotometer and thereby likewise controlling the quantity of the wash. Both concepts have nothing to do with the observation of physical values in flowing quantities of syrup during a centrifuging process and provide no motivation for so doing.

Moreover, in a particularly preferred embodiment, there are provided one or more further annular channels with associated drainage openings, connecting lines and receiving containers as well as shut-off assemblies which are arranged above or below the first annular channel on the inner wall of the centrifuge housing.

With this somewhat more constructionally demanding modification of the invention, it is possible to increase the quality of the separation process for the two types of discharge still more whilst nevertheless using all the advantages of an external separation process.

Thus again, maintenance and cleaning are only needed outside the centrifuge housing and the corresponding shutoff devices and connecting lines can again be replaced for exchange units outside the centrifuge housing and they can be cleaned and maintained without being subject to time pressures.

Moreover, due to the additional connecting line with the additional shutoff device, it is also possible to specially and purposefully sluice out the green run-off that was first collected and is present in the annular channel and supply it to the rest of the green run-off that is collected in the first receiving container as in the first embodiment.

The quality of the white run-off in the second receiving container is thus increased yet again.

DESCRIPTION OF THE DRAWINGS

Further embodiments and modifications are explained in more detail in the following description of the Figures.

Some exemplary embodiments of the invention are described in more detail hereinafter with the aid of the drawings. Therein:

FIG. 1 shows a schematic principle illustration of a section through a partial region of a first embodiment of a device in accordance with the invention comprising a centrifuge housing;

FIG. 2 a schematic principle illustration of a section through a partial region of a second embodiment of a device in accordance with the invention comprising a centrifuge housing;

DETAILED DESCRIPTION

Figure 3:
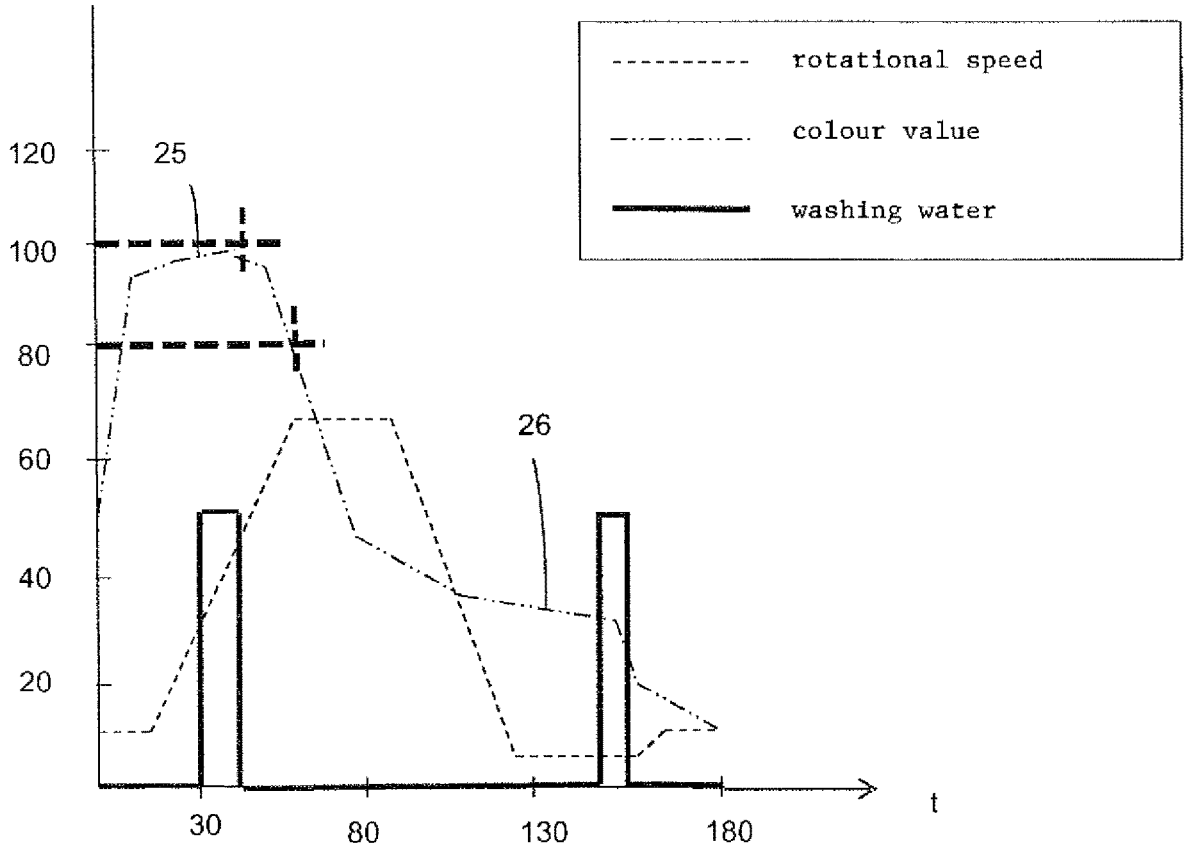
FIG. 3 a schematic illustration of the curve for a physical value which is representative of the difference between green run-off and white run-off during the processing of a charge plotted against time.

A schematically depicted vertical section through a device comprising a centrifuge housing 10 can be perceived in FIG. 1. The centrifuge housing 10 has the usual cylindrical wall 11 and a base 12. In the FIG. 1, one can only see a detail of an edge region including the transition from the wall 11 to the base 12.

Moreover, the centrifuge housing 10 accommodates a rotating cylindrical centrifuge drum 20. Here too, only a corner area of the centrifuge drum 20 is schematically depicted. When in operation, sugar massecuite is centrifuged within the centrifuge drum 20, whereby a syrup in the form of green run-off and white run-off passes outwardly through the casing, namely, onto the inner surface of the wall 11 of the centrifuge housing 10.

Thus in temporal sequence, firstly a so-called green run-off having a high proportion of non-sugar material, followed by a white run-off having a high sugar content and finally a washing liquid enriched with sugar crystals, impinge against the inner surface of the wall 11 of the centrifuge housing 10.

These different substances are of different viscosity but they all run downwardly on the inner surface of the wall 11.

Consequently, the green run-off initially emerging from the centrifuge drum 20 is also the first to impinge against the inner wall 11, it runs downwardly on the wall 11 and then runs into a gutter in the form of an annular channel 30. This annular channel 30 is fixed around the inner surface of the wall 11. It has an annular channel wall 31 and an annular channel base 32. The annular channel wall 31 is approximately parallel to the wall 11 of the centrifuge housing 10 and extends through 360° over the entire periphery of the wall 11.

To a first approximation, the annular channel base 32 is horizontal but it is inclined so that the annular channel 30 has a deepest point.

In most embodiments of the invention, the inclination of the base 32 of the annular channel 30 falls within the range of 2° to 30°, preferably between 5° and 10°.

The green run-off running into the annular channel 30 thus fills this annular channel 30 up to the upper edge 33 of the annular channel wall 31.

Once the annular channel 30 is filled with the green run-off in this way, the green run-off runs over the upper edge 33 of the annular channel wall 31 and the overflowing part then flows, drips or falls onto the base 12 of the centrifuge housing 10.

The capacity of the annular channel 30 is deliberately selected in such a way that an overwhelming proportion of the green run-off runs over the upper edge 33 of the annular channel wall 31 in this way and drips onto the base 12 of the centrifuge housing 10.

A drainage opening 41 is provided at or in the base 12 of the centrifuge housing 10. A connecting line 51 is attached to this drainage opening 41 which may be closable.

The connecting line 51 leads to a receiving container 61. The green run-off which has collected on the base 12 of the centrifuge housing 10 runs through the drainage opening 41 and the connecting line 51 into the receiving container 61 which is filled with green run-off in this way and, in addition, contains no other substance.

In order to ensure the intended discharge of the green run-off through the drainage opening 41, provision is made for the base 12 of the centrifuge housing 10 to be likewise inclined or it may be equipped with appropriate built-in features that are inclined for the purposes of combining the green run-off into one location of the centrifuge housing 10.

A further drainage opening 42 is provided in the wall 11, namely, in the region where the annular channel 30 is located on the inner surface of the wall 11.

This drainage opening 42 is connected to a second receiving container 62 by means of a connecting line 52.

At first however, this drainage opening now remains closed. An appropriate closure device or shut-off assembly 71 in the form of a valve is schematically drawn in FIG. 1.

Since, at this time point, the shut-off assembly 71 prevents the green run-off in the annular channel 30 from draining away through the drainage opening 42 and the connecting line 52 into the receiving container 62, the receiving container 62 initially remains empty.

A sensor 80, which determines a physical value of the syrup flowing past it, is integrated into the wall 11. In particular here, this value could be the colour of the syrup. For this purpose, there are characteristic colour values, a typical value for the colour of green run-off amounting to about 20,000 to 25,000 Icumsa units, which is also abbreviated to IU (Icumsa Units).

During the treatment of a charge, the physical value, i.e. the colour determined by the sensor 80 will rise steeply at first and then adopt a maximum value, whereby certain fluctuations and inaccuracies can occur here. As tests have shown, the maximum value will be reached approximately when the phase of adding washing liquid to the sugar massecuites concludes, and also, at about the time point at which the centrifuge drum that is being continually accelerated has reached its maximum value after the acceleration process.

The maximum value then remains constant for a period of time, from which it can be derived that the green run-off is occurring unchanged during the centrifuging process and is passing the sensor 80.

If, during operation of the centrifuge drum 20, the time point has now arrived at which, instead of the green run-off that first ensued, white run-off is emerging outwardly through the centrifuge drum 20 onto the inner surface of the wall 11 of the centrifuge housing 10, running down the wall 11 and passing the sensor 80, then the latter will detect a very abrupt and significant drop in the colour value.

As experiments have established, the value drops significantly and more or less steeply depending upon the charge, in dependence on the filling quantity and on special considerations, but in each case in an extremely short period of time commensurate with the total period required for the treatment of a charge.

In all, the value falls to the region of 10,000 Icumsa units or even lower.

A threshold can therefore be selected from this which amounts to between approximately 60 and 85% of the previously reached maximum value of the colour. If the size of the physical value, thus here the colour, that is measured by the sensor 80 falls below the threshold value, then it is immediately certain that it does not relate to one of the usual variations that have often arisen before, but actually to the expected sudden change from green run-off to white run-off which is just beginning.

The values of the sensor 80 are now passed on in wireless manner or else over a cable to a control system 81 which is likewise only indicated schematically in FIG. 1. If the control device 81 receives this information and recognizes the sudden change from green run-off to white run-off, then the shut-off assembly 71 is opened. The green run-off present in the annular channel 30 that has not run over the upper edge of the annular channel wall 31 onto the base 12 now runs through the connecting line 52 into the receiving container 62 which thereby likewise fills with a limited quantity of green run-off, namely, with a volume which corresponds exactly to the contents of the annular channel 30 between the upper edge of the annular channel wall 31, the annular channel base 32 and the wall 11.

After the discharge of this defined and prior known quantity of green run-off, only white run-off from the wall 11 will reach the annular channel 30 and from there will enter the receiving container 62 via the opened drainage opening 42, the opened shut-off assembly 71 and the connecting line 52.

The entire white run-off and the washing water including the dissolved sugar crystals is then supplied to the receiving container 62 over this path during the following time period.

The receiving container 62 thus contains a relatively precisely defined mixture consisting of green run-off and white run-off which can be pre-determined by the choice of the dimensions of the annular channel 30 and the choice of the height of the upper edge of the annular channel wall 31. Experiments have shown that defined mixing ratios of approximately 10 to 20 parts green run-off to approximately 90 to approximately 80 parts white run-off can be achieved here in a precisely settable manner. These ratios are significantly better and more precise than the mixtures which were conventionally possible using external, controlled valve circuitry when separating a uniform discharge from centrifuge housings.

Thus, although one has quite intentionally and deliberately allowed a pre-determined volume of green run-off to enter the receiving container 62 intended for white run-off and thereby "contaminated" the white run-off, nevertheless the quality of the separation process is higher. In addition, it should also be taken into consideration that there really is only green run-off amounting to 100% in the receiving container 61 for the green run-off so that no contaminants are present therein.

A modified embodiment can be seen in FIG. 2 which, to a large extent, adopts the concepts from the first embodiment and is also illustrated in a similar manner.

Here, one can again see, in the form of a vertical section, a corner of a centrifuge housing 10 with a wall 11 and a base 12. Within the centrifuge housing 10, there is a centrifuge drum 20 from which green run-off and later on white run-off, will reach the inner surface of the wall 11 of the centrifuge housing 10.

Once more, the annular channel 30 with an annular channel wall 31 and an annular channel base 32 can also be perceived. Here too, the annular channel 30 forms a surrounding collecting gutter for the outwardly directed green run-off arriving first from the centrifuge drum 20.

Again, the receiving containers 61 and 62 as well as the drainage openings 41 and 42 and the connecting lines 51 and 52 can also be perceived.

Additional to the embodiment from FIG. 1, provision is now made for yet another connecting line 53 which branches off from the connecting line 52 between the drainage opening 42 and the shut-off assembly 71 and opens into the other connecting line 51 in the form of a sort of short-circuiting line. This connecting line 53 is separately closable or blockable by means of an additional shut-off assembly 72.

Indicated once more is a sensor 80 which is positioned close to the drainage opening 42 in the connecting line 52 or 53 prior to the shut-off assembly 71 and is connected to a control device 81.

Self-evidently in this modified embodiment, green run-off again enters the annular channel 30 first. The shut-off assembly 71 is closed. The shut-off assembly 72 is initially opened or alternatively closed for a short pre-determined period of time. This means that the green run-off accumulates in the annular channel 30 and finally runs over the upper edge of the annular channel wall 31 onto the base 12 of the centrifuge housing 10 and flows into the receiving container 61 in like manner to the first embodiment.

If the sensor 80 in the connecting line 52 or 53 now establishes that there is an indication that the green run-off from the centrifuge drum 20 has been superseded by white run-off, the shut-off assembly 72 in the connecting line 53 is opened or kept open by the control device 81. The shut-off assembly 71 remains closed. The contents of the annular channel 30 with the green run-off that was collected there first can then be fed, at short notice if necessary, through the connecting line 53 to the connecting line 51 and into the receiving container 61. Subsequently, in the presence of a still falling ICUMSA value or alternatively in this case too, in accord with a very short time slot after the preceding event, the shut-off assembly 71 is now opened. The white run-off that is following the green run-off and is now running into the annular channel 30 from above can now run through the connecting line 52 and the opened shut-off assembly 71 into the receiving container 62. The receiving container 62 is now collecting practically only white run-off.

In a further embodiment, the shut-off assembly 72 may be kept open by the control device 81 until such time as the sensor 80 transmits values according to which the green run-off has been superseded by white run-off.

The concept of FIG. 2 thus leads to an almost optimal process of segregation of the green run-off relative to the white run-off. Up to 100% green run-off is again present in the receiving container 61, albeit via two supply paths, whereas only white run-off is present in the receiving container 62. Only very slight traces of the undesired discharge can be found in the respective receiving containers, whereby these traces are limited to those mixtures of substances which occur directly at the transition from green run-off to white run-off within the comparatively small volume of the annular channel 30 due to the mixing process occurring whist they are running in the annular channel. In comparison to the inexactitudes prevailing in the state of the art even when using apparatus of complex construction, this is disappearingly small.

In principle (although not illustrated), an arrangement of the sensor 80 in the connecting line 51 beyond the drainage opening 41 would also be possible. However, the mixture of green run-off 25 and white run-off 26 on the base 12 of the centrifuge housing 10 leads to a less abrupt change in the physically measured value of the sensor 80 in such an arrangement, which change moreover is only ascertainable and usable in the control device 81 after some delay.

FIG. 3 shows a plot over time of the different values occurring during the processing of a charge in the centrifuge drum 20. The time t is plotted to the right in seconds. The value 0 designates the moment marking the beginning of the process of filling the centrifuge drum 20 with sugar massecuite of a new charge.

Plotted upwardly are various values which in differing form refer to variously illustrated curves.

One of the curves relates to the rotational speed of the centrifuge drum 20. One sees that during the process of filling the sugar massecuite, a low basic speed of the rotary drum prevails, that it is then accelerated thereafter up to a maximum value which remains constant for some time and then decreases again.

It is likewise indicated that washing water is applied to the centrifuge drum at two different time points, whereby this washing water could also be a sugar solution from another processing stage.

A third and here particularly interesting curve now relates to the progression in the value for the colour which is determined by the sensor 80. A relative value has been plotted upwardly here for illustrative purposes. One sees that the colour value rises steeply at first and then more slowly until it adopts the maximum value of 100% of the reached colour value. It remains there for some time and then drops very steeply. This drop then becomes a plateau, the height of which depends on the type of sugar massecuite, the processing stage, the quantity of sugar massecuite and further criteria. The value lies somewhere between just a few % and perhaps barely 60% of the maximum value.

From this, one can infer that the determination of a drop to a range of between 60 and 85% of the maximum value is an excellent criterion as to whether the sensor 80 has just determined that there is green run-off or white run-off in the connecting line 52 or 53.

Additionally, it is apparent from FIG. 3 that green run-off 25 is evidently present in the discharge on the left-hand side and white run-off 26 to the right in the region of the plateau.

Figure 4:
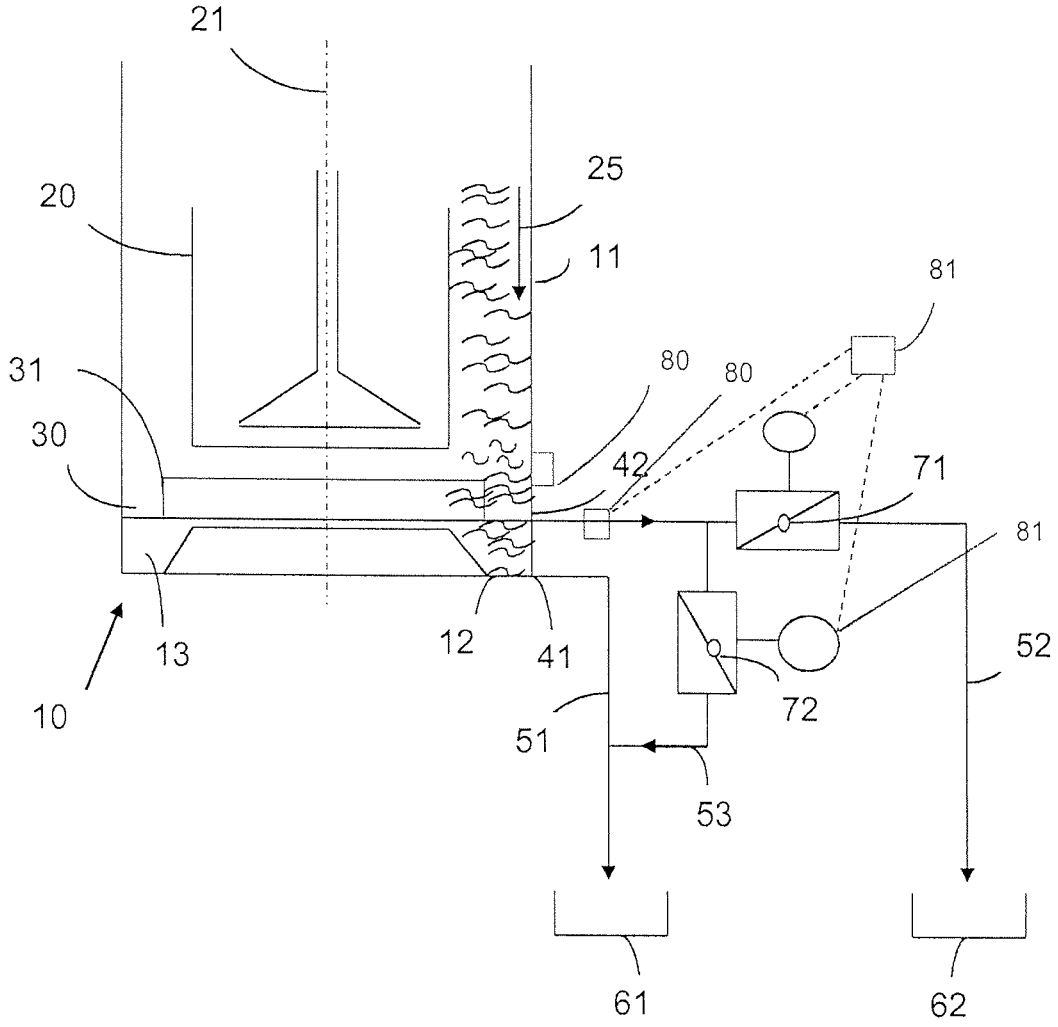
FIG. 4 a more detailed illustration of a modified embodiment of the invention in accordance with the invention.

A somewhat more detailed embodiment is illustrated in FIG. 4 which corresponds to a large extent to the concept from the second embodiment in FIG. 2.

Other than is the case in FIGS. 1 and 2, the entire centrifuge housing 10 with its wall 11 and the base 12 can be perceived here (not to scale). The centrifuge drum 20 which rotates about an axis 21 is located therein. The discharge then reaches the inner surface of the wall 11 from the centrifuge drum 20.

As indicated here by the arrow in FIG. 4, the quantity of green run-off 25 firstly runs down the wall. It then fills the discharge gutter or the annular channel 30 below until it has filled the latter to the upper edge of the annular channel wall 31.

One perceives here that the annular channel 30 extends peripherally and its wall 31 can be formed by a cylindrical drum which may be in the form of a fitting in the interior of the cylinder housing 10 and standing on a corresponding pedestal.

In the illustration in FIG. 4, after filling the annular channel 30, the green run-off 25 then runs inwardly over the upper edge of the annular channel wall 31 into an underlying, likewise channel-like retainer 13 which is located above the base 12.

Afterwards, the green run-off then runs via the drainage opening 41 and the connecting line 51 to the receiving container 61.

One can again see that the white run-off can run via the drainage opening 42 in the area of the annular channel 30 through the shut-off assembly 71 and the connecting device 52 into the receiving container 62, whereby the initially captured green run-off can also be fed off in front of the white run-off through a short-circuit connecting line 53 containing a shut-off assembly 72 into the connecting line 51 and then on into the receiving container 61.

Figure 5:
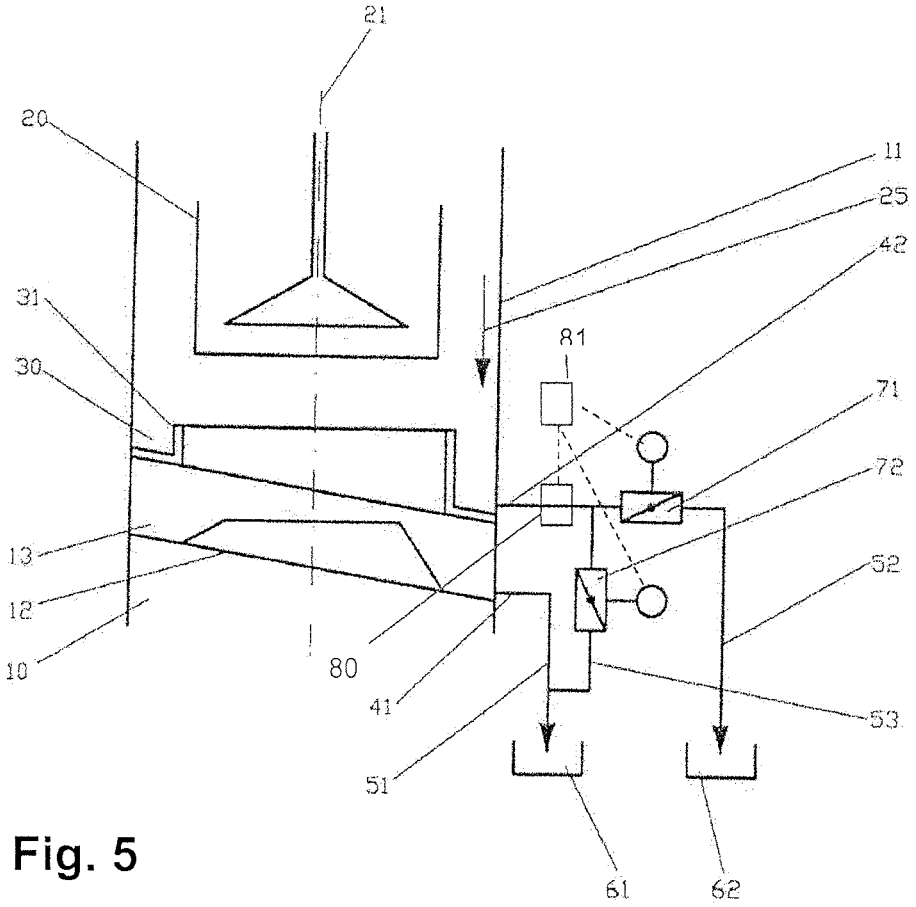
FIG. 5 a schematic illustration of a further modified embodiment of the invention.
Figure 5A:
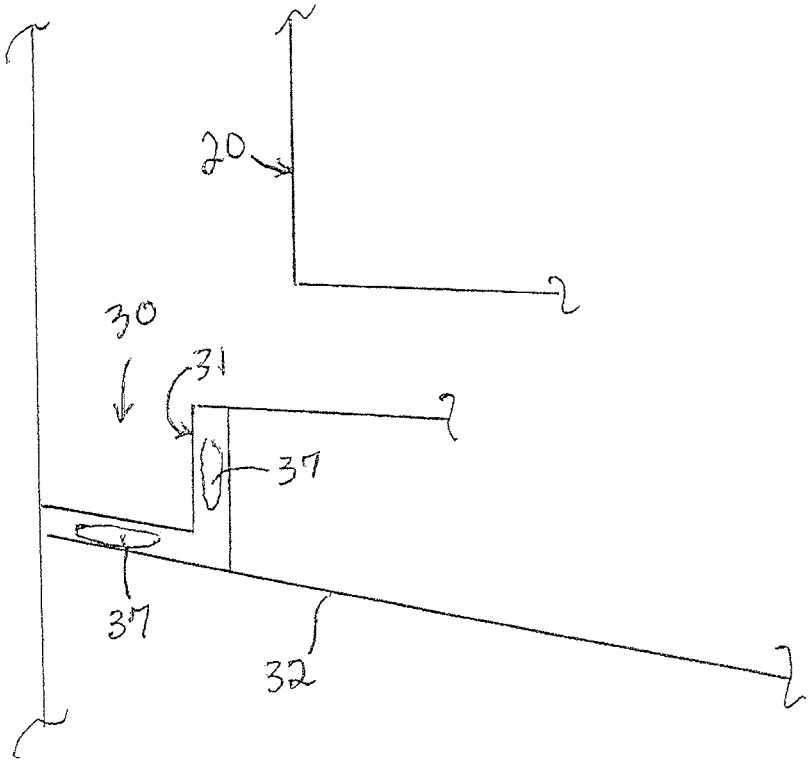
FIG. 5A is an enlarged fragmentary view taken from FIG. 5, and showing the incorporation of heating elements 37 within the double wall structure at the channel.

Yet another schematic illustration is depicted in FIG. 5, from which it can be gathered that the annular channel 30 has an inclined annular channel base 32 in order to enable the quantity of the current contents of the annular channel 30 to be supplied to the drainage opening 42 in a targeted manner.

One can readily perceive this from the fact that the annular channel base 32 itself is not only inclined but it is also located higher in the side of the wall 11 of the centrifuge housing 10 illustrated to the left in FIG. 5 than it is in the side of the wall 11 illustrated to the right in FIG. 5. This shows that the annular channel base 31 also has at least one lower lying region within the wall 11 in the peripheral orientation and correspondingly, has inclined sections which lead the white run-off and the green run-off to pre-determined drainage openings 42.

Moreover, the discharge gutter or the annular channel 30 is intentionally illustrated as being double-walled in FIG. 5. By virtue of this double-walled illustration, it is simultaneously indicated that the annular channel 30 comprising the annular channel base 32 and the annular channel wall 31 could be equipped with heating elements 37 thereby enabling the annular channel 30 and the substance located therein to be heated. The heating element 37 may be arranged in a double wall annular channel wall and/or a double-walled annular channel base. In this way in particular, the relatively viscous green run-off can be deliberately heated up just prior to the change to the white run-off. In this phase, the viscosity of the green run-off is significantly reduced in this way. Consequently, this green run-off would run out from the annular channel 30 at a significantly faster rate. This would have the consequence that the separation of green and white run-off will be additionally improved.

Figure 6:
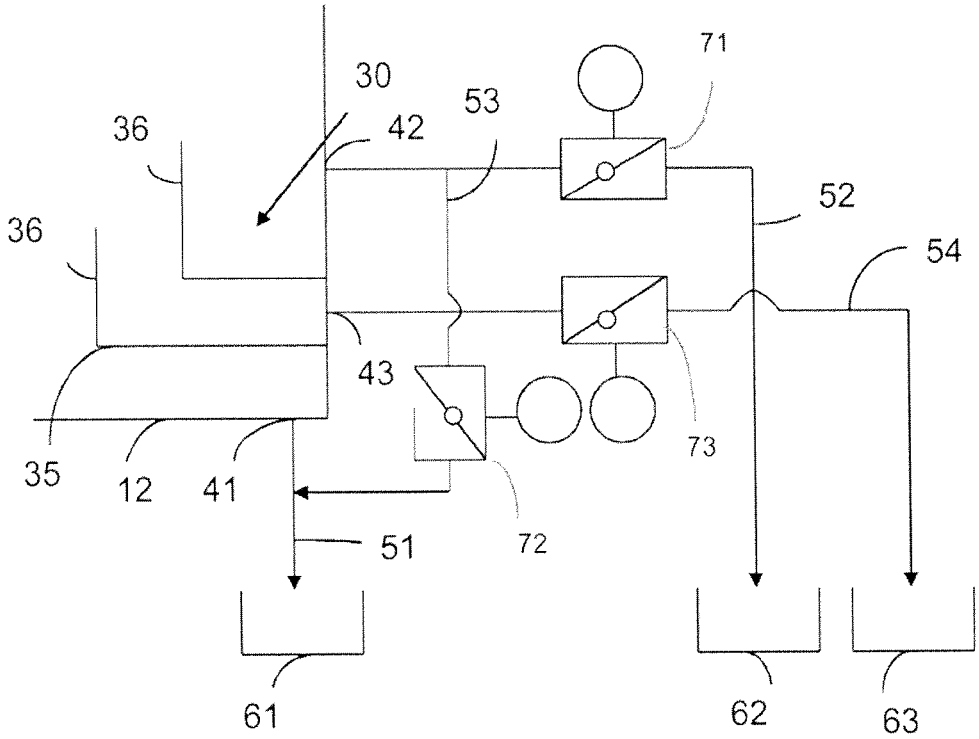
FIG. 6 a schematic principle illustration of a section through a partial region of a further embodiment of a device in accordance with the invention comprising a centrifuge housing.

A further modified embodiment which is constructionally more complicated but which can perfect the already excellent results for the separation process still further is illustrated in FIG. 6.

In addition to the annular channel 30 with its annular channel wall 31, this embodiment has yet another second annular channel 35 with an annular channel wall 36 that is located below it.

This second or lower annular channel 35 accommodates a quantity of green run-off or white run-off which runs over the upper edge of the annular channel wall 31 and, for its part, lets those volumetric fractions which exceed its own maximum capacity run over its own annular channel wall 36.

By appropriate control of the timing, the result can now be deliberately achieved that certain volumetric fractions in the transition region from the green run-off to the white run-off for instance will enter this second annular channel 35 and be separated out.

It is thereby possible to supply the volumetric fractions collected in this second annular channel 35 through a further drainage opening 43 and a connecting line 54 to a receiving container 63. Additionally, a third shut-off assembly 73 is provided here.

Here too, a sensor 80 can be arranged in the wall 11 above the drainage opening 42 or in the connecting line 52/53 immediately following the point of attachment to the drainage opening 42. Once again, a control device 81 takes over the task of controlling the shut-off assemblies 71, 72 and 73 in dependence on the values measured by the sensor 80. For better perception of the variations of the other structures from the embodiments of FIGS. 1, 2, 4 and 5, the sensor 80 and the control device 81 are not depicted here.

Figure 7:
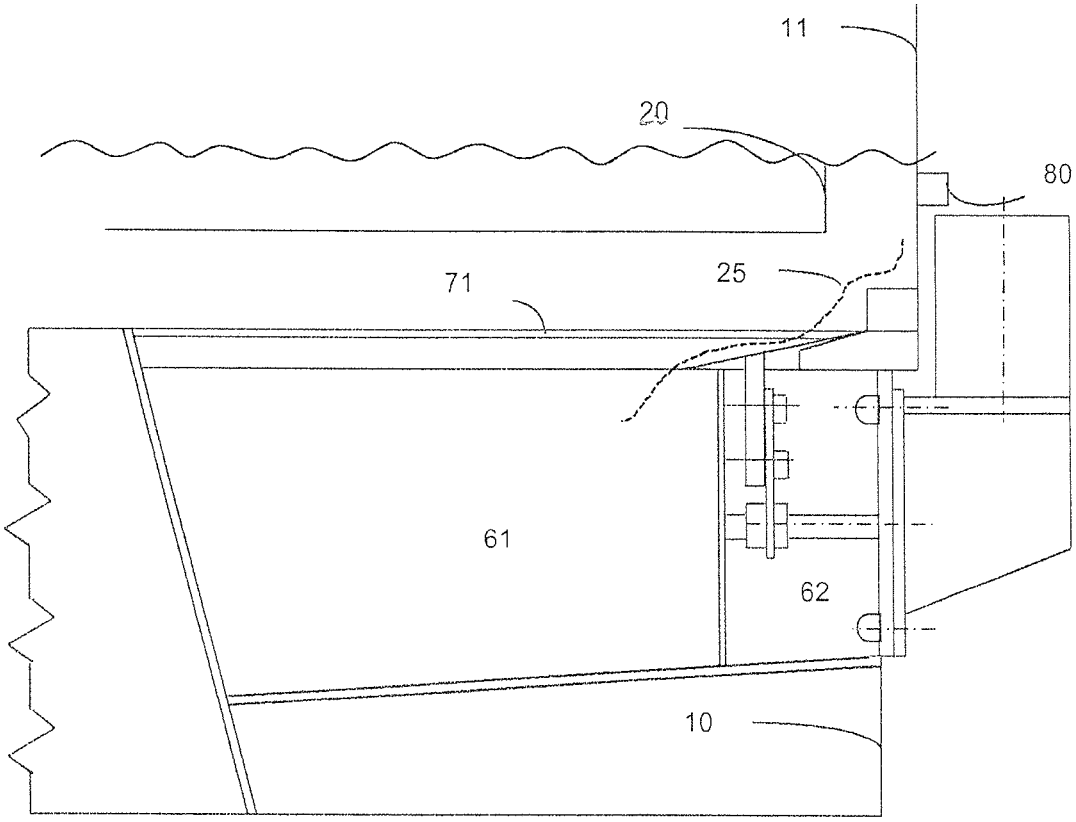
FIG. 7 a schematic illustration of a section through another embodiment of the invention.

The lower region of a centrifuge drum 20 in a further exemplary embodiment can be perceived in FIG. 7. A centrifuge housing 10 surrounds the centrifuge drum 20. A wall 11 of the centrifuge housing 10 is provided against which the syrup masses centrifuged by the centrifuge drum 20 impinge. These run down along the wall 11. Here, we are concerned first of all with green run-off 25.

Whilst running down the wall 11, the green run-off 25 passes the sensor 80. The sensor 80 thereby measures a physical value which denotes the colour or luminosity or electrical conductivity of the passing syrup for example. It transmits these measured values to a (not illustrated) control device 81.

The green run-off 25 now reaches a shut-off assembly 71. In the illustrated embodiment, this shut-off assembly 71 is a raisable and lowerable cover element which is already in the closed position in FIG. 7. This means that a flat cone-like sealing surface of this cover element of the shut-off assembly 71 is resting upon a stationary counter cone.

Since therefore the shut-off assembly 71 is in the closed position, the green run-off 25 runs into a first receiving container 61 over the illustrated sloping part. Here, this receiving container 61 forms an annular chamber which is arranged around the centrifuge housing 10 in annular-fashion underneath the centrifuge drum 20.

The not illustrated control device 81 controls the lifting and lowering of the shut-off assembly 71 in dependence on the values measured by the sensor 80. If now, instead of green run-off 25, white run-off 26 is running past the sensor 80 then the cover-type shut-off assembly 71 is raised. The flat cone on the lower surface of the cover-like element thereby separates from its counter cone and frees the entrance into the second receiving container 62. Here, this is likewise an annular chamber which extends around the centrifuge housing 10 outside the first annular chamber of the first receiving container 61.

Furthermore, there are indicated other elements which effect the processes of lifting and lowering the raisable and lower able first shut-off assembly 71 and are thereby controlled by the control device 81.

After the detection of the change from green run-off 25 to white run-off 26 by the sensor 80, it is therefore possible in this embodiment too, to effect precise control of the time point at which actuation of the first shut-off assembly 71 should take place and to do it accordingly.

In the embodiment of FIG. 7, the annular chambers illustrated in the form of a cross-section only represent a part of the receiving containers 61, 62. Basically, the illustrated annular chambers serve for the initially separate reception process and then for forwarding the green run-off 25 and the white run-off 26. Receiving containers 61, 62 or larger volume regions of these receiving containers 61, 62 can be arranged below the illustrated region and/or outside the centrifuge housing 10 as well.

Thus, the term "receiving containers 61, 62" is to be understood as meaning those container elements that are provided overall for separately receiving the syrup draining from the centrifuge drum 20 in accordance with green run-off 25 and white run-off 26.

LIST OF REFERENCE SYMBOLS

10 centrifuge housing
11 wall of the centrifuge housing
12 base of the centrifuge housing
13 collecting gutter at the base of the centrifuge housing
20 centrifuge drum
21 centrifuge axis
25 green run-off
26 white run-off
30 annular channel
31 annular channel wall
32 annular channel base
35 second annular channel
36 wall of the second annular channel
41 drainage opening in the base
42 drainage opening in the annular channel
43 drainage opening in the second annular channel
51 connecting line from the base
52 connecting line from the annular channel

53 connecting line in the form of a short-circuiting line
54 connecting line from the second annular channel
61 first receiving container
62 second receiving container
63 third receiving container
71 first shut-off assembly
72 second shut-off assembly
73 third shut-off assembly
80 sensor
81 control device

What is claimed is:

1. A device comprising a discontinuously operating centrifuge that operates discontinuously in batch-type manner for separating syrup from sugar massecuites, comprising:

a centrifuge housing having an upright wall and a base with the upright wall extending upwardly and transverse to the base, a cylindrical centrifuge drum in the centrifuge housing, drainage openings in the centrifuge housing including respective first and second drainage openings, a first receiving container for the syrup for receiving green run-off, a second receiving container for the syrup for receiving white run-off, a first connecting line coupling from the first drainage opening to the first receiving container, a second connecting line coupling from the second drainage opening to the second receiving container, a peripheral annular channel in the centrifuge housing underneath the centrifuge drum and above or on the base of the centrifuge housing, said peripheral annular channel including an annular channel base and an upright annular channel wall having an upper edge, wherein the first drainage opening is disposed in one of the base of the centrifuge housing and the upright wall of the centrifuge housing, and the second drainage opening is disposed in the upright wall of the centrifuge housing at a location within the peripheral annular channel and spaced below the upper edge of the upright annular channel wall, a control device, a valve or shut-off assembly which is controllable by the control device and located at or in the second connecting line, at least one sensor in a transport path of the syrup between a point of impingement of the syrup on the wall of the centrifuge housing and the controllable valve or shut-off assembly, the sensor having a measuring device for the measurement of a physical value which is representative of the difference between green run-off and white run-off, the control device is configured in such a way that it controls the valve or shut-off assembly in dependence on a measured value of the physical value transmitted by the sensor, wherein the valve or shut-off assembly has open and closed positions and, by control from the control device, is maintained closed as long as green run-off is sensed and opens when the sensor senses a transition from green run-off to white run-off;

and wherein the annular channel base is disposed spaced above the base of the centrifuge housing.

2. A device in accordance with claim 1, characterized in that the measuring device for the measurement of a physical value measures the luminosity, the colour, the change in luminosity over time, the change in colour over time, the conductivity and/or the change in conductivity over time as the physical value.

3. A device comprising a discontinuously operating centrifuge in accordance with claim 1, characterized in that the control device is designed in such a way that it effects change-over of the controllable valve or shut-off assembly in such a way that the latter is switched-over if the measured value of the physical value transmitted by the sensor falls below a threshold which amounts to between 60 and 85% of the maximum measured value of the physical value that was previously measured in the same charge.

4. A device comprising a discontinuously operating centrifuge in accordance with claim 1, characterized in that each of the first and second receiving containers include respective concentric annular chambers which are concentrically arranged relative to the centrifuge housing.

5. A device comprising a discontinuously operating centrifuge in accordance with claim 1, characterized in that the annular channel has an annular channel base which has an inclination of one of more than 2° and less than 30°, and more than 5° and less than 10°.

6. A device comprising a discontinuously operating centrifuge in accordance with claim 1, characterized in that the annular channel has an annular channel wall having an upper edge which is dimensioned such that the maximum volume accommodatable by the annular channel amounts to one of less than 50% and less than 15% of the entire discharge volume of syrup occurring during a working cycle of the discontinuously operating centrifuge drum.

7. A device comprising a discontinuously operating centrifuge in accordance with claim 1, characterized in that the annular channel is equipped with heating elements which are arranged in a double-walled annular channel wall and/or a double-walled annular channel base.

8. A device comprising a discontinuously operating centrifuge in accordance with claim 1, characterized in that the first and second drainage openings are mutually equally spaced around the periphery of the centrifuge housing, and in that the base of the centrifuge housing and/or the annular channel base have an inclination that is selected in such a way that the first and second drainage openings are located at respective deepest points of the base of the centrifuge housing and the annular channel base.

9. A device comprising a discontinuously operating centrifuge that operates discontinuously in batch-type manner for separating syrup from sugar massecuites, comprising:

a centrifuge housing having a wall and a base, a cylindrical centrifuge drum in the centrifuge housing, drainage openings in the centrifuge housing, a first receiving container for the syrup draining from the drainage openings for receiving green run-off, a second receiving container for the syrup draining from the drainage openings for receiving white run-off, a first connecting line coupling from a first drainage opening to the first receiving container, a second connecting line coupling from a second drainage opening to the second receiving container, a control device, a valve or shut-off assembly which is controllable by the control device and located at or in the second connecting line for the purposes of separating green run-off and white run-off, at least one sensor in a transport path of the syrup between a point of impingement of the syrup on the wall of the centrifuge housing and the controllable valve or shut-off assembly, the sensor having a measuring device for the measurement of a physical value which is representative of the difference between green run-off and white run-off, the control device is configured in such a way that it controls the valve or shut-off assembly in dependence on a measured value of the physical value transmitted by the sensor, a peripheral annular channel in the centrifuge housing underneath the centrifuge drum and above or on the base, in that a third connecting line having a second valve or shut-off assembly branches off from the second connecting line from the drainage opening in the annular channel to the second receiving container and leads to the first connecting line above the first receiving container.

10. A device comprising a discontinuously operating centrifuge in accordance with claim 9, characterized in that the measuring device for the measurement of a physical value measures the luminosity, the colour, the change in luminosity over time, the change in colour over time, the conductivity and/or the change in conductivity over time as the physical value;

in that the control device is designed in such a way that it effects change-over of the controllable valve or shut-off assembly in such a way that the latter is switched-over if the measured value of the physical value transmitted by the sensor falls below a threshold which amounts to between 60 and 85% of the maximum measured value of the physical value that was previously measured in the same charge.

11. A device comprising a discontinuously operating centrifuge that operates discontinuously in batch-type manner for separating syrup from sugar massecuites, comprising:

a centrifuge housing having a wall and a base, a cylindrical centrifuge drum in the centrifuge housing, drainage openings in the centrifuge housing, a first receiving container for the syrup draining from the drainage openings for receiving green run-off, a second receiving container for the syrup draining from the drainage openings for receiving white run-off, a first connecting line coupling from a first drainage opening to the first receiving container, a second connecting line coupling from a second drainage opening to the second receiving container, a control device, a valve or shut-off assembly which is controllable by the control device and located at or in the second connecting line for the purposes of separating green run-off and white run-off, at least one sensor in a transport path of the syrup between a point of impingement of the syrup on the wall of the centrifuge housing and the controllable valve or shut-off assembly, the sensor having a measuring device for the measurement of a physical value which is representative of the difference between green run-off and white run-off, the control device is configured in such a way that it controls the valve or shut-off assembly in dependence on a measured value of the physical value transmitted by the sensor, a peripheral annular channel in the centrifuge housing underneath the centrifuge drum and above or on the base, in that there are provided one or more further annular channels having associated respective drainage openings, connecting lines and receiving containers as well as shut-off assemblies which are arranged above or below the first annular channel on the inner wall of the centrifuge housing.

12. A method for the operation of a device having a centrifuge that operates discontinuously in batch-type manner for separating syrup from sugar massecuites, comprising:

a centrifuge housing having a wall and a base, a cylindrical centrifuge drum in the centrifuge housing, drainage openings in the centrifuge housing, first and second connecting lines from respective drainage openings, a first receiving container for the syrup draining from the drainage openings for receiving green run-off, a second receiving container for the syrup draining from the drainage openings for receiving white run-off, a peripheral annular channel in the centrifuge housing underneath the centrifuge drum and above or on the base of the centrifuge housing, said peripheral annular channel including a channel base and a channel wall having an upper edge, a control device, a valve or shut-off assembly which is controllable by the control device and located at or in the drainage openings or in the respective connecting lines from the drainage openings to the receiving containers for the purpose of separating green run-off and white run-off, at least one sensor in a transport path of the syrup between a point of impingement of the syrup on the wall of the centrifuge housing and the controllable valve or shut-off assembly, the sensor having a measuring device for the measurement of a physical value which is representative of the difference between green run-off and white run-off, the control device is configured in such a way that it controls the valve or shut-off assembly in dependence on the measured values of the physical value transmitted by the sensor, wherein, in the method, a physical value which is representative of the difference between green run-off and white run-off is measured in the transport path of the syrup between the point of impingement of the syrup on the wall of the centrifuge housing and the controllable valve and shut-off assembly, wherein the valve or shut-off assembly is controlled in dependence on the measured values of the physical value in such a way that the syrup components detected as green run-off or white run-off flow to the receiving containers assigned to the reception thereof, in that, during the centrifuging process, the green run-off is initially collected in the annular channel, in that, after the filling of the annular channel with green run-off, the excess green run-off is allowed to run over the upper edge of the annular channel wall and reach the base of the centrifuge housing, in that, upon the change from green run-off to white run-off from the centrifuge drum, the valve or shut-off assembly in the second connecting line opens and the content of the annular channel flows into the second receiving container, in that the white run-off is collected in the annular channel and is likewise fed into the second receiving container, and in that the green run-off on the base is fed into the first receiving container.

13. A method for the operation of a device having a centrifuge that operates discontinuously in batch-type manner for separating syrup from sugar massecuites, comprising:

a centrifuge housing having a wall and a base, a cylindrical centrifuge drum in the centrifuge housing, drainage openings in the centrifuge housing, a first receiving container for the syrup draining from the drainage openings for receiving green run-off, a second receiving container for the syrup draining from the drainage openings for receiving white run-off, a first connecting line coupling from a first drainage opening to the first receiving container, a second connecting line coupling from a second drainage opening to the second receiving container, a control device, a valve or shut-off assembly which is controllable by the control device and located at or in the second connecting line for the purposes of separating green run-off and white run-off, at least one sensor in a transport path of the syrup between a point of impingement of the syrup on the wall of the centrifuge housing and the controllable valve or shut-off assembly, the sensor having a measuring device for the measurement of a physical value which is representative of the difference between green run-off and white run-off, the control device is configured in such a way that it controls the valve or shut-off assembly in dependence on the measured values of the physical value transmitted by the sensor, a peripheral annular channel in the centrifuge housing underneath the centrifuge drum and above or on the base, said peripheral annular channel having a base and a wall with an upper edge;

in that there is provided in the base a first drainage opening to which a first connecting line to the first receiving container is attached, in that there is provided in the annular channel a second drainage opening to which a second connecting line to the second receiving container is attached, and in that the valve or shut-off assembly is arranged in the second connecting line and is set in such a way that it opens in dependence on the time point at which the syrup arriving at the inner surface of the wall of the centrifuge housing from the centrifuge drum changes from green run-off to white run-off, in that, during the centrifuging process, the green run-off is initially collected in the annular channel, in that, after the filling of the annular channel with green run-off, the excess green run-off is allowed to run over the upper edge of the annular channel wall and reach the base of the centrifuge housing, in that, upon the change from green run-off to white run-off from the centrifuge drum, the valve or shut-off assembly in the second connecting line opens and the content of the annular channel flows into the second receiving container, in that the white run-off is collected in the annular channel and is likewise fed into the second receiving container, and in that the green run-off on the base is fed into the first receiving container.

14. The method of claim 13 including providing heating elements which are arranged in a double-walled annular channel wall and/or a double-walled annular channel base.

15. The method of claim 13 wherein the physical value measures the luminosity, the colour, the change in luminosity over time, the change in colour over time, the conductivity and/or the change in conductivity over time as the physical value.

16. The method of claim 13 wherein the physical value which is representative of the difference between green run-off and white run-off is measured in the transport path of the syrup between the point of impingement of the syrup on the wall of the centrifuge housing and the controllable valve or shut-off assembly, and wherein the valve or shut-off assembly is controlled in dependence on the measured values of the physical value in such a way that the syrup components detected as green run-off or white run-off flow to the receiving containers assigned to the reception thereof.

17. A discontinuously operating centrifuge for separating sugar comprising:

a centrifuge housing having an upright wall and a base with the upright wall extending upwardly and transverse to the base, a cylindrical centrifuge drum in the centrifuge housing, drainage openings in the centrifuge housing including respective first and second drainage openings, a first receiving container for the syrup draining from the centrifuge housing for receiving green run-off;

a second receiving container for the syrup draining from the centrifuge housing for receiving white run-off;

a first connecting line coupling from the first drainage opening to the first receiving container, a second connecting line coupling from the second drainage opening to the second receiving container, a peripheral annular channel in the centrifuge housing underneath the centrifuge drum and above or on the base of the centrifuge housing, said peripheral annular channel including an annular channel base and an upright annular channel wall having an upper edge, wherein the first drainage opening is disposed in one of the base of the centrifuge housing and the upright wall of the centrifuge housing, and the second drainage opening is disposed in the upright wall of the centrifuge housing at a location within the peripheral annular channel and spaced below the upper edge of the upright annular channel wall, a control device;

a valve which is controllable by the control device and located at or in the second connecting line;

at least one sensor in a transport path of the syrup between a point of impingement of the syrup on the wall of the centrifuge housing and the controllable valve;

wherein the sensor has a measuring device for the measurement of a physical value which is representative of the difference between green run-off and white run-off;

wherein the control device is configured in such a way that it controls the valve in dependence on a measured value of the physical value transmitted by the sensor;

wherein the valve has open and closed positions and is arranged in the second connecting line between the second drainage opening and the second container and is maintained closed as long as green run-off is sensed and opens when the sensor senses a transition from green run-off to white run-off;

and wherein the annular channel base is disposed spaced above the base of the centrifuge housing.

18. The discontinuously operating centrifuge of claim 17 wherein the drainage openings include a plurality of drainage openings provided in the base and a plurality of drainage openings provided in the annular channel.

19. The discontinuously operating centrifuge of claim 17 wherein the channel base and base of the centrifuge housing are both inclined relative to a longitudinal axis of the centrifuge drum.

20. A discontinuously operating centrifuge for separating sugar comprising:

a centrifuge housing having an upright wall and a base with the upright wall extending upwardly and transverse to the base;

a cylindrical centrifuge drum disposed in the centrifuge housing;

drainage openings in the centrifuge housing;

a first receiving container for the syrup draining from the centrifuge housing for receiving green run-off;

a second receiving container for the syrup draining from the centrifuge housing for receiving white run-off;

a first connecting line coupling to the first receiving container, a second connecting line coupling to the second receiving container, a control device;

a valve which is controllable by the control device and located at or in the drainage openings or in respective first and second connecting lines from respective drainage openings to the receiving containers for the purpose of separating green run-off and white run-off;

at least one sensor in a transport path of the syrup between a point of impingement of the syrup on the wall of the centrifuge housing and the controllable valve;

wherein the sensor has a measuring device for the measurement of a physical value which is representative of the difference between green run-off and white run-off;

wherein the control device is configured in such a way that it controls the valve in dependence on a measured value of the physical value transmitted by the sensor;

an annular channel in the centrifuge housing underneath the centrifuge drum and above or on the base;

wherein the drainage openings comprise a first drainage opening in the housing base to which the first connecting line to the first receiving container is attached;

wherein the drainage openings also comprise a second drainage opening in the annular channel to which the second connecting line to the second receiving container is attached;

wherein the annular channel includes an annular channel base and an upright annular channel wall having an upper overflow edge and the second drainage opening is disposed in a sidewall of the annular channel at a location below the upper overflow edge;

wherein the valve has open and closed positions and is arranged in the second connecting line between the second drainage opening and the second container and is maintained closed as long as green run-off is sensed and opens when the sensor senses a transition from green run-off to white run-off;

and wherein the annular channel base is disposed spaced above the base of the centrifuge housing.

21. The discontinuously operating centrifuge of claim 20 wherein the drainage openings include a plurality of drainage openings provided in the base and a plurality of drainage openings provided in the annular channel.

22. The discontinuously operating centrifuge of claim 20 wherein the channel base and base of the centrifuge housing are both inclined relative to a longitudinal axis of the centrifuge drum.

23. The discontinuously operating centrifuge of claim 20 wherein the base of the centrifuge housing is formed as an annular collecting gutter.

24. The discontinuously operating centrifuge of claim 23 wherein the base of the centrifuge housing includes a projection from the base that forms thereabout the annular collecting gutter.

25. The discontinuously operating centrifuge of claim 20 wherein the annular channel base is disposed substantially in parallel to the base of the centrifuge housing.

* * * * *